US008587580B2

(12) United States Patent
Kim et al.

(10) Patent No.: US 8,587,580 B2
(45) Date of Patent: Nov. 19, 2013

(54) LIQUID CRYSTAL DISPLAY

(75) Inventors: Il-Nam Kim, Yongin (KR); Won-Sang Park, Yongin (KR); Min-Woo Kim, Yongin (KR); Jae-Kyoung Kim, Yongin (KR); Dong-Hun Lim, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 325 days.

(21) Appl. No.: 12/966,866

(22) Filed: Dec. 13, 2010

(65) Prior Publication Data

US 2012/0013596 A1 Jan. 19, 2012

(30) Foreign Application Priority Data

Jul. 15, 2010 (KR) ..... 10-2010-0068451

(51) Int. Cl.
*G09G 3/36* (2006.01)
*G09G 5/00* (2006.01)

(52) U.S. Cl.
USPC ..... 345/212; 345/90; 345/96

(58) Field of Classification Search
USPC ..... 345/87–104, 212, 204
See application file for complete search history.

(56) References Cited

U.S. PATENT DOCUMENTS

2005/0190138 A1* 9/2005 Jung ..... 345/96
2006/0284811 A1* 12/2006 Huang ..... 345/92
2008/0024689 A1* 1/2008 Ahn ..... 349/43
2008/0055216 A1* 3/2008 Yen et al. ..... 345/87
2008/0303768 A1* 12/2008 Do et al. ..... 345/90
2009/0135323 A1* 5/2009 Yang et al. ..... 349/37
2010/0123702 A1* 5/2010 Kim ..... 345/211

FOREIGN PATENT DOCUMENTS

JP 2000-193937 7/2000
KR 10-0685819 2/2007
KR 10-2008-0073953 8/2008
KR 10-2010-0004769 A 1/2010

OTHER PUBLICATIONS

Korean Notice of Allowance issued on Mar. 12, 2012 in connection with Korean Patent Application Serial No. 10-2010-0068451 and Request for Entry of the Accompanying Office Action attached herewith.
Korean Office action issued by Korean Patent Office on Jul. 29, 2011, corresponding to KR 10-2010-0068451 and Request for Entry attached herewith.

* cited by examiner

*Primary Examiner* — Jimmy H Nguyen
(74) *Attorney, Agent, or Firm* — Robert E. Bushnell, Esq.

(57) ABSTRACT

A pixel structure of a liquid crystal cell that is implemented in a filed sequential liquid crystal display and a method of driving the same. The liquid crystal display includes: a liquid crystal display panel including a plurality of scan lines and data lines, and a plurality of pixels connected to the scan lines and the data lines and arranged in a matrix form; a control signal generating unit for providing a control signal and a reset signal to the pixels of the liquid crystal display panel respectively; a common voltage generating unit for providing a common voltage to the respective pixels; and a boosting voltage generating unit for providing a boosting voltage to the respective pixels.

5 Claims, 4 Drawing Sheets

1 FRAME
1 SUB FRAME (previous stage)
1 SUB FRAME (current stage)
B
R
G
t1
t2
t3
t4
Vb2
Vb1
Positive level (+)
Negative level (−)

Vb1'
Vb1
Positive level (+)
Negative level (−)

Vb2
Vb2'
Positive level (+)
Negative level (−)

Vb1'
Vb2'
Positive level (+)
Negative level (−)

LIQUID CRYSTAL DISPLAY

CLAIM OF PRIORITY

This application makes reference to, incorporates the same herein, and claims all benefits accruing under 35 U.S.C. §119 from an application earlier filed in the Korean Industrial Property Office on Jul. 15, 2010, and there duly assigned Serial No. 10-2010-0068451 by that Office.

BACKGROUND OF THE INVENTION

1. Field of the Invention

The present invention relates to a liquid crystal display, and more particularly to a field sequential liquid crystal display.

2. Description of the Related Art

A liquid crystal display is a device for applying an electric field to liquid crystal material having anisotropic dielectric which is injected between two substrates and for controlling intensity of the electric field to adjust an amount of light transmitting through the substrates from an external light source (backlight) to obtain a desired image signal.

This liquid crystal display is a typical device of easy-portable flat displays and among the flat displays a TFT-LCD using thin film transistor (TFT) as switching devices is mainly used.

The liquid crystal display, in general, displays a desired image by forming primary color filter layers having red (R), green (G), and blue (B) colors on one of the two substrates and by controlling the amount of light transmitting through the color filter layers. That is, the conventional color filter liquid crystal display displays a desired image by controlling the amount of light transmitting through the R, G and B color filter layers to combine R, G and B colors when the light projected from a single light source passes through the R, G and B color filters.

However, since the liquid crystal display for displaying an image using the single light source and the three color filter layers need unit pixels respectively corresponding to R, G and B regions, the conventional liquid crystal display needs pixels more than three times when displaying a black-white image. Therefore, in order to obtain a high definition image, a precise manufacturing technology is required of the liquid crystal display panel. In addition, such liquid crystal display had disadvantage in manufacturing of forming an additional color filter layer on a substrate and has a low brightness because of low light transmission of the color filter.

In order to overcome these drawbacks, a field sequential liquid crystal display is proposed.

The field sequential liquid crystal display turns on independent light sources of R, G and B colors sequentially and applies corresponding color signals to respective pixels in synchronizing with the turning-on period to obtain a full color image. According to the field sequential liquid crystal display, one pixel is not divided into unit pixels of R, G and B colors but R, G and B primary color light, which are output from R, G and B color backlights respectively, are sequentially displayed in time divisional way to display an image using an afterimage.

That is, the field sequential liquid crystal display does not have a color filter but includes a sequential backlight for emitting R, G and B color lights sequentially.

In addition, the field sequential liquid crystal display is generally driven by a digital method such that one field frame is time-divided into at least three sub-frames and red color light, green color light, and blue color light are sequentially displayed in the respective sub-frames to display colors.

At this time, each of the sub-frames is divided into a region of addressing respective liquid crystal cell arrays, a region of charging liquid crystal cells with an applied image signal, a region of projecting the backlight, and a region of resetting the liquid crystal cells. That is, each of the sub-frames can project a corresponding backlight only after an image signal is completely input to all liquid crystal cells (particularly, a liquid crystal cell finally addressed).

Due to this structural problem, the conventional field sequential liquid crystal display requires time for transmitting video data to all pixels in a state when one frame is divided into three sub-frames, and thus time for displaying actual brightness is restricted.

Therefore, the field sequential liquid crystal display must project light only after signals are addressed to the respective pixels and the liquid crystal is completely driven by the signals, and thus requires an additional liquid crystal cell structure and a driving method thereof in order to lengthen time for projecting light.

SUMMARY OF THE INVENTION

Accordingly, the present invention has been made to provide a pixel structure of a liquid crystal cell that is implemented in a filed sequential liquid crystal display and a method of driving the same.

In order to achieve the foregoing and/or other aspects of the present invention, there is provided a liquid crystal display including: a liquid crystal display panel including a plurality of scan lines and data lines, and a plurality of pixels connected to the scan lines and the data lines and arranged in a matrix form; a control signal generating unit for providing a control signal and a reset signal to the pixels of the liquid crystal display panel respectively; a common voltage generating unit for providing a common voltage to the respective pixels; and a boosting voltage generating unit for providing a boosting voltage to the respective pixels.

Here, each of the pixels includes: a first thin film transistor, a gate electrode of which is connected to the scan lines and a source electrode of which is connected to the data lines; a second thin film transistor, a source electrode of which is connected to a drain electrode of the first thin film transistor and a gate electrode of which is connected to a write control signal line; a third thin film transistor, a gate electrode of which is connected to a reset control signal line and a source electrode of which is connected to a drain electrode of the second thin film transistor; a storage capacitor provided between the drain electrode of the first thin film transistor and the common voltage; a liquid crystal capacitor, a first electrode of which is connected to the drain electrode of the second thin film transistor; and a boosting capacitor, a first electrode of which is connected to the source electrode of the third thin film transistor.

In addition, the common voltage is applied to the second electrode of the liquid crystal capacitor and the boosting voltage is applied to a second electrode of the boosting capacitor.

In this case, the boosting voltage applied to the respective pixels is applied to every odd number column and every even number column as the same voltage, or a first boosting voltage is applied to the pixels connected to the odd number columns and a second boosting voltage is applied to the pixels connected to the even number columns.

In addition, polarities of the first boosting voltage and the second boosting voltage are different at respective sub-frames.

Otherwise, a boosting voltage is applied to a second electrode of the boosting capacitor, a boosting voltage of reversed phase is applied to a second electrode of the liquid crystal capacitor, or the common voltage is applied to a second electrode of the boosting capacitor and a boosting voltage of reversed phase is applied to a second electrode of the liquid crystal capacitor.

According to the present invention, while image data corresponding to a specific color light is stored in a storage capacitor, a different color light of a previous stage is projected to achieve improved brightness, and a pixel structure of a liquid crystal cell proper to the field sequential driving method is proposed so that various reverse driving can be enabled.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE EMBODIMENTS

Figure 1:
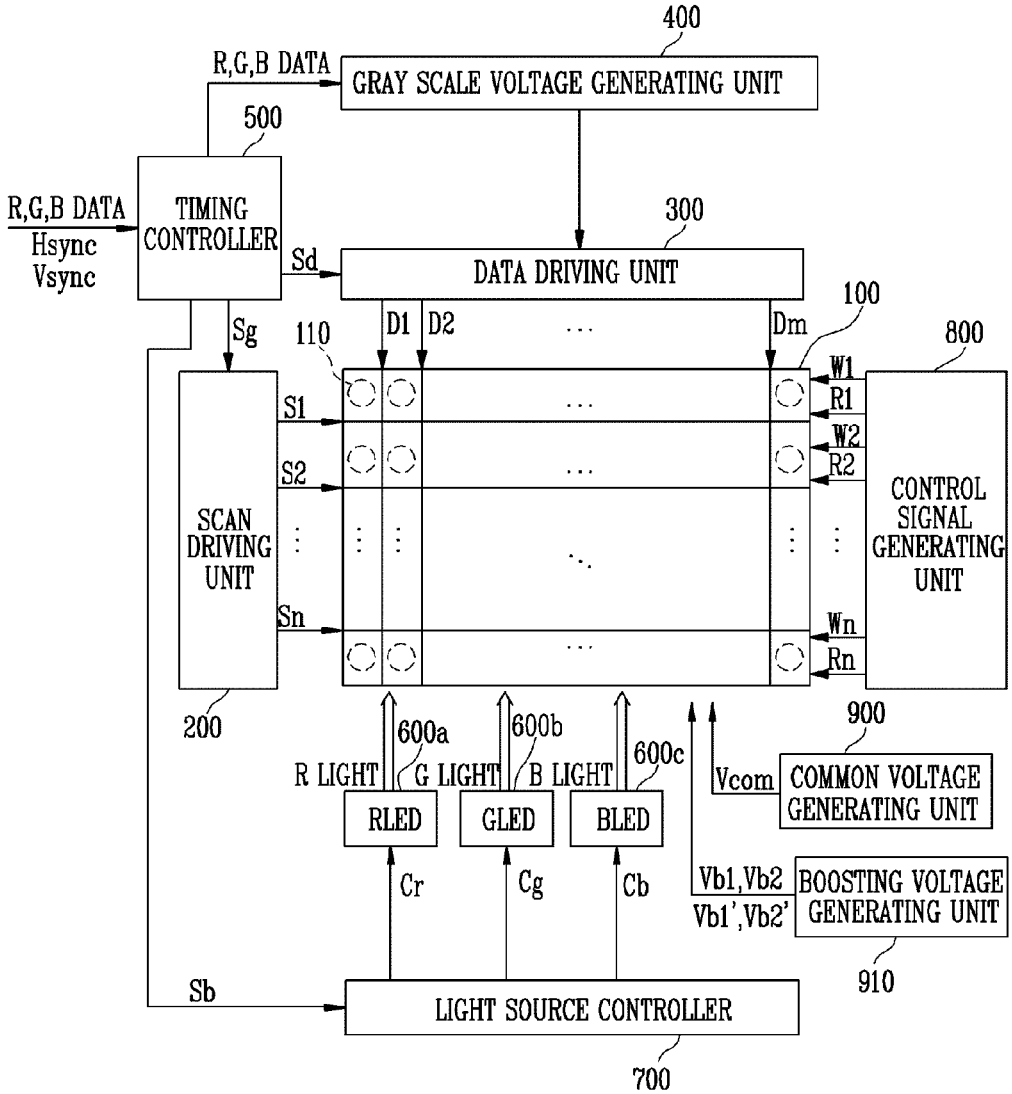
FIG. 1 is a block diagram illustrating a liquid crystal display according to an embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. In addition, when an element is referred to as being "on" another element, it can be directly on the another element or be indirectly on the another element with one or more intervening elements interposed therebetween. Also, when an element is referred to as being "connected to" another element, it can be directly connected to the another element or be indirectly connected to the another element with one or more intervening elements interposed therebetween. Hereinafter, like reference numerals refer to like elements.

Hereinafter, embodiments of the present invention will be described in detail with reference to the accompanying drawings.

FIG. 1 is a block diagram illustrating a liquid crystal display according to an embodiment of the present invention.

Referring to FIG. 1, a liquid crystal display according to an embodiment of the present invention includes a liquid crystal panel 100, a scan driving unit 200, a data driving unit 300, a gray scale voltage generating unit 400, a timing controller 500, light emitting diodes 600*a*, 600*b* and 600*c* for outputting R, G and B color lights, and a light source controller 700.

In addition, the liquid crystal display according to the embodiment of the present invention further includes a control signal generating unit 800 for providing write signals W1 to Wn and reset signals R1 to Rn to a plurality of pixels 110 included in the liquid crystal display panel 100, a common voltage generating unit 900 for providing a common voltage Vcom to the respective pixels 110, and a boosting voltage generating unit 910 for providing boosting voltages Vb1 or Vb2 to the respective pixels 110. Boosting voltages Vb1' or Vb2' will be described later.

The liquid crystal panel 100 includes a plurality of scan lines S1 to Sn and data lines D1 to Dm and a plurality of pixels 110 connected thereto and arranged in a column and row array.

In this case, each of the pixels 110 (described in more detail later with respect to FIGS. 2A to 2C) includes a first thin film transistor (not shown) connected to the scan lines and the data lines, a liquid crystal capacitor Clc (not shown) connected to the first thin film transistor, and a storage capacitor Cst (not shown), and in this embodiment of the present invention further includes a boosting capacitor Cb (not shown) connected to the liquid crystal capacitor, a second thin film transistor (not shown) connected between the liquid crystal capacitor and the storage capacitor; and a third thin film transistor (not shown) connected to the boosting capacitor.

In the liquid crystal capacitor Clc, pixel electrodes (not shown) and common electrodes (not shown) of the respective pixels serve as two electrodes and a liquid crystal layer between the two electrodes functions as a dielectric. The pixel electrodes are connected to a drain electrode (not shown) of the first thin film transistor and the common electrode may receive the common voltage Vcom provided by the common voltage generating unit 900.

In addition, the storage capacitor Cst is formed by which a lower electrode (not shown) and the pixel electrodes are overlapped with each other and the lower electrode is electrically connected to the common electrode such that the common voltage Vcom may be applied thereto.

However, in this embodiment of the present invention, the boosting capacitor Cb connected to the liquid crystal capacitor Clc is formed by which the pixel electrodes and storage lines (not shown) are overlapped with each other and as described above the boosting voltage Vb1 or Vb2 provided from the boosting voltage generating unit 910 is applied to the storage lines.

In this case, On/Off of the third thin film transistor is controlled by the reset signals R1 to Rn outputted from the control signal generating unit 800 and On/Off of the second thin film transistor is controlled by the write control signals W1 to Wn. The structure and operation of the pixels will be described later with reference to FIGS. 2A to 2C, 3 and 4A to 4C in detail.

In addition, the scan driving unit 200 sequentially applies scan signals to the scan lines S1 to Sn and turns on the first thin film transistors of the respective pixels gate electrodes of which are connected to the scan lines to which the scan signals are applied.

The gray scale voltage generating unit 400 generates gray scale voltages corresponding to R, G and B data and supplies the same to the data driving unit 300. The data driving unit 300 applies the gray scale voltages outputted from the gray scale voltage generating unit 400 to corresponding data lines.

The timing controller 500 receives R, G and B image signals R, G, B DATA, vertical synchronizing signals Vsync and horizontal synchronizing signals for controlling displaying of the R, G and B image signals R, G, B DATA from an external graphic controller (not shown).

The timing controller 500 properly processes the image signals R, G, B DATA under the operating condition of the liquid crystal display panel 100 based on the input image signals R, G, B DATA and input control signals, generates a gate control signal Sg, a data control signal Sd, and a light source control signal Sb, transmits the gate control signal Sg to the scan driving unit 200, transmits the data control signal Sd to the data driving unit 300, transmits the processed image signals R, G, B DATA to the gray scale voltage generating unit 400, and transmits the light source control signal Sb to the light source controller 700.

The light emitting diodes 600*a*, 600*b*, and 600*c* output light corresponding to R, G and B color lights to the liquid crystal display panel 100, and, in response to the transmits the light source control signal Sb, the light source controller 700 generates control signals Cr, Cg and Cb to respectively control On/Off of the light emitting diodes 600*a*, 600*b*, and 600*c*.

Figure 2A:
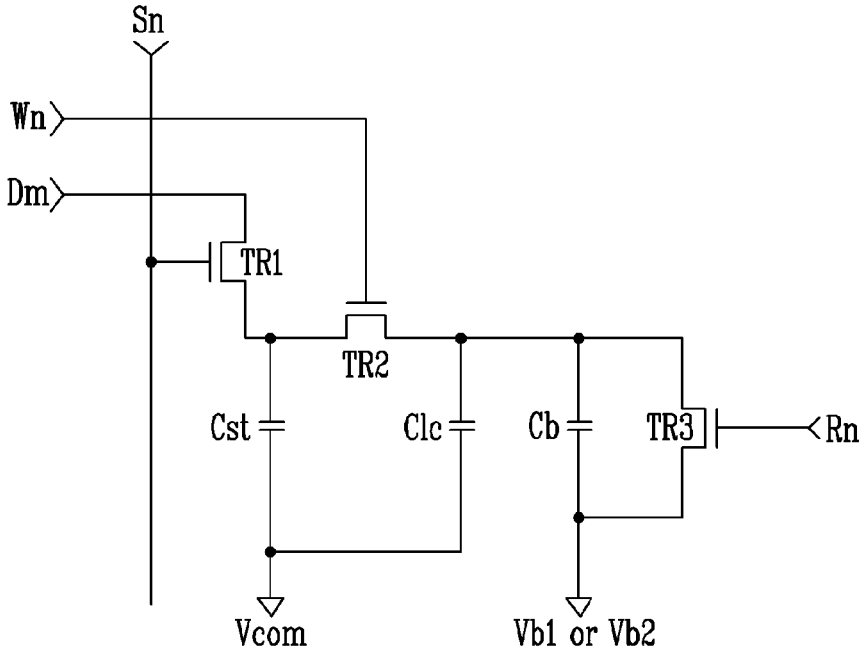
FIGS. 2A to 2C are equivalent circuits of a pixel circuit according to the embodiment of the present invention.
Figure 2B:
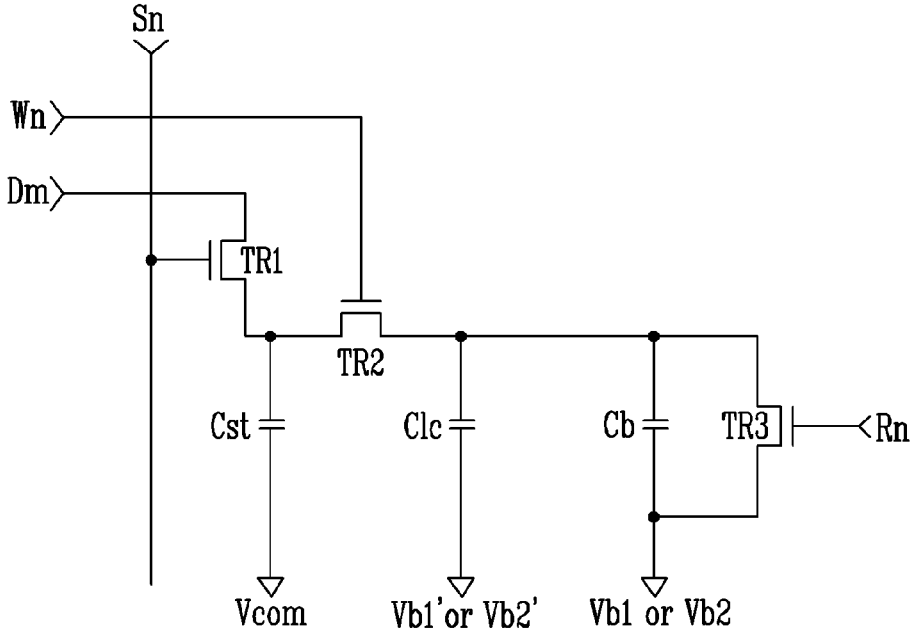
Figure 2C:
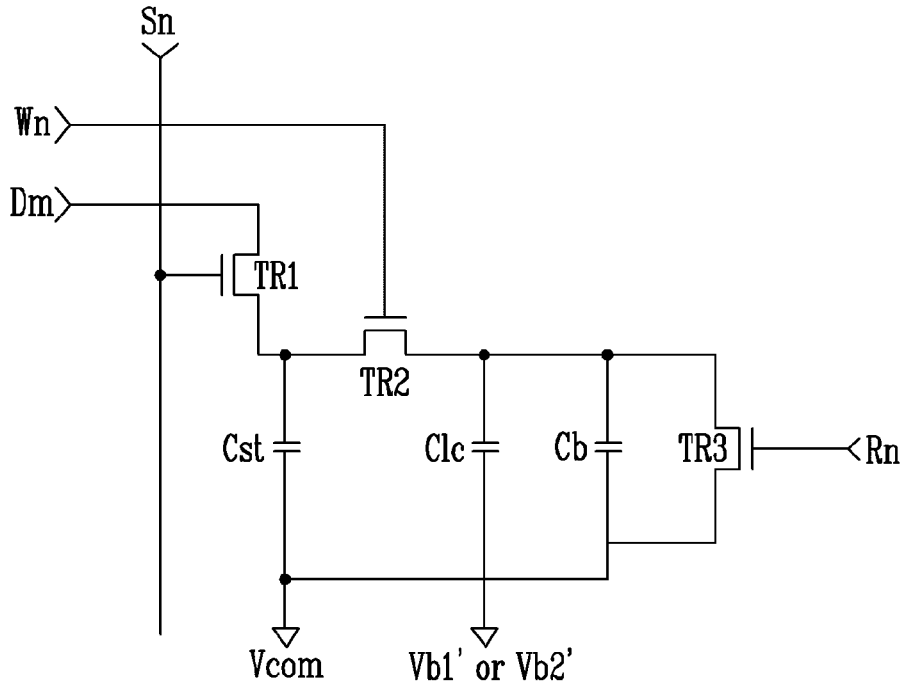

FIGS. 2A to 2C are equivalent circuits of a pixel circuit according to the embodiment of the present invention.

However, for the purpose of description, FIGS. 2A to 2C show a pixel in which an nth scan line Sn is connected to an mth data line.

Referring to FIGS. 2A to 2C, each of the pixels includes the first thin film transistor TR1, a gate electrode of which is connected to the scan line Sn and a source electrode of which is connected to the data line Dm, a second thin film transistor TR2, a source electrode of which is connected to a drain electrode of the first thin film transistor TR1 and a gate electrode of which is connected to the write control signal line Wn, a third thin film transistor TR3, a gate electrode of which is connected to the reset control signal line Rn and a source electrode of which is connected to a drain electrode of the second thin film transistor TR2, and the storage capacitor Cst provided between the drain electrode of the first thin film transistor TR1 and the common voltage Vcom.

Moreover, each of the pixels, according to respective embodiments, as illustrated in the drawings, further includes the liquid crystal capacitor Clc and the boosting capacitor Cb. Voltages applied to the liquid crystal capacitor Clc and the boosting capacitor Cb are different in the pixels as illustrated in FIGS. 2A to 2C.

First, in the embodiment as illustrated in FIG. 2A, the liquid crystal capacitor Clc is provided between the drain electrode of the second thin film transistor TR2 and the common voltage Vcom, and the boosting capacitor Cb is provided between the source and drain electrodes of the third thin film transistor TR3, the drain electrode being further connected the boosting voltage Vb1 or Vb2.

That is, in the pixel of FIG. 2A, the voltage applied to a second electrode of the liquid crystal capacitor Clc is a first voltage source, that is, the common voltage Vcom and the voltage applied to a second electrode of the boosting capacitor Cb is a second voltage source, that is, the boosting voltage Vb1 or Vb2.

At this time, the boosting voltages Vb1 and Vb2 applied to the respective pixels are identically applied to every even or odd columns such that the first boosting voltage Vb1 is applied to the pixels connected to the odd columns and the second boosting voltage Vb2 is applied to the pixels connected to the even columns.

Next, in the pixel of the embodiment as illustrated in FIG. 2B, the boosting capacitor Cb is provided between the source and drain electrodes of the third thin film transistor TR3, the drain electrode being further connected the boosting voltage Vb1 or Vb2 like the pixel as illustrated in FIG. 2A, but a boosting voltage Vb1' or Vb2' with reversed phase is applied to the second electrode of liquid crystal capacitor Clc, instead of the common voltage Vcom of FIG. 2A.

Finally, in the pixel of an embodiment as illustrated in FIG. 2C, the first voltage source, that is, the common voltage Vcom is applied to the second electrode of the boosting capacitor Cb and the boosting voltage Vb1' or Vb2' with reversed phase is applied to the second electrode of the liquid crystal capacitor Clc.

Figure 3:
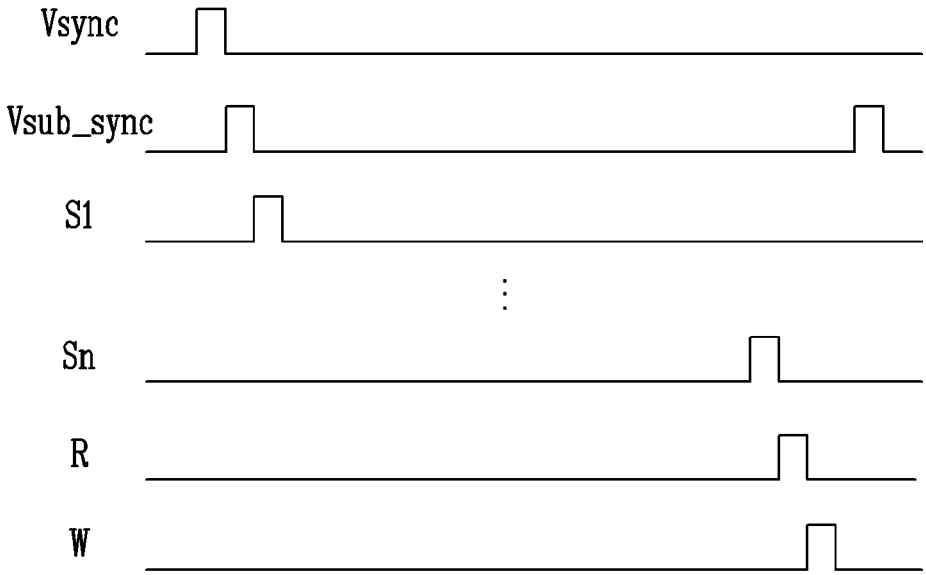
FIG. 3 is a timing diagram illustrating timing of a signal applied to the pixel of FIGS. 2A to 2C.

FIG. 3 is a timing diagram illustrating timing of a signal applied to the pixel of FIGS. 2A to 2C.

However, with respect to FIG. 3, only timing of a signal will be described except for the common voltage and the boosting voltage that are differently applied in the respective embodiments of FIGS. 2A to 2C.

Operations of the respective pixels according to the embodiment of the present invention will be described with reference to FIGS. 2A to 2C and 3.

First, a sub-frame starting signal Vsub_sync for starting one of the R, G and B color lights starts according to a frame starting signal Vsync. Image data applied to a first column pixel is prepared and a first column scan signal S1 is activated.

When the first thin film transistors TR1 of the respective pixels electrically connected to the first column are turned 'on' according to the first column scan signal S1, the image data is stored in the storage capacitor Cst. When the final scan signal Sn is sequentially activated in the same manner, transmission of the image signals to the storage capacitor of all pixels in the liquid crystal display panel is completed.

Next, liquid crystals of all pixels provided in the liquid crystal display panel are reset at the same time or sequentially. At this time, the reset of the liquid crystals means that charges remaining in the pixel electrodes flow to the common electrode and that the reset signals R are applied to the third thin film transistors TR3 of the respective pixels to turn 'on' the third thin film transistors TR3 in the equivalent circuit.

Finally, when the write control signal W are applied to all pixels in the liquid crystal display panel, the second thin film transistors TR2 are turned 'on' and the image signals stored in the storage capacitor Cst are transmitted to the liquid crystal capacitor Clc and the boosting capacitor Cb.

That is, each of the image signals stored in the storage capacitor Cst is transmitted to each of the liquid crystal capacitors Cls of the respective pixels and backlights of corresponding colors are turned on so that a correct image may be appeared to eyes of a user.

However, voltage drop occurs when the voltage stored in the storage capacitor Cst is transmitted to the liquid crystal capacitor Clc and the boosting capacitor Cb by the application of the write control signal, and a correct gray scale may not be displayed due to the voltage drop.

Therefore, in the embodiment of the present invention, in order to overcome the above-mentioned drawbacks, the boosting voltage is applied to the boosting capacitor Cb or the boosting voltage of reversed phase is applied to the liquid crystal capacitor Clc to compensate the voltage drop occurring when the voltage stored in the storage capacitor Cst is transmitted.

Figures 4A, 4B, 4C:
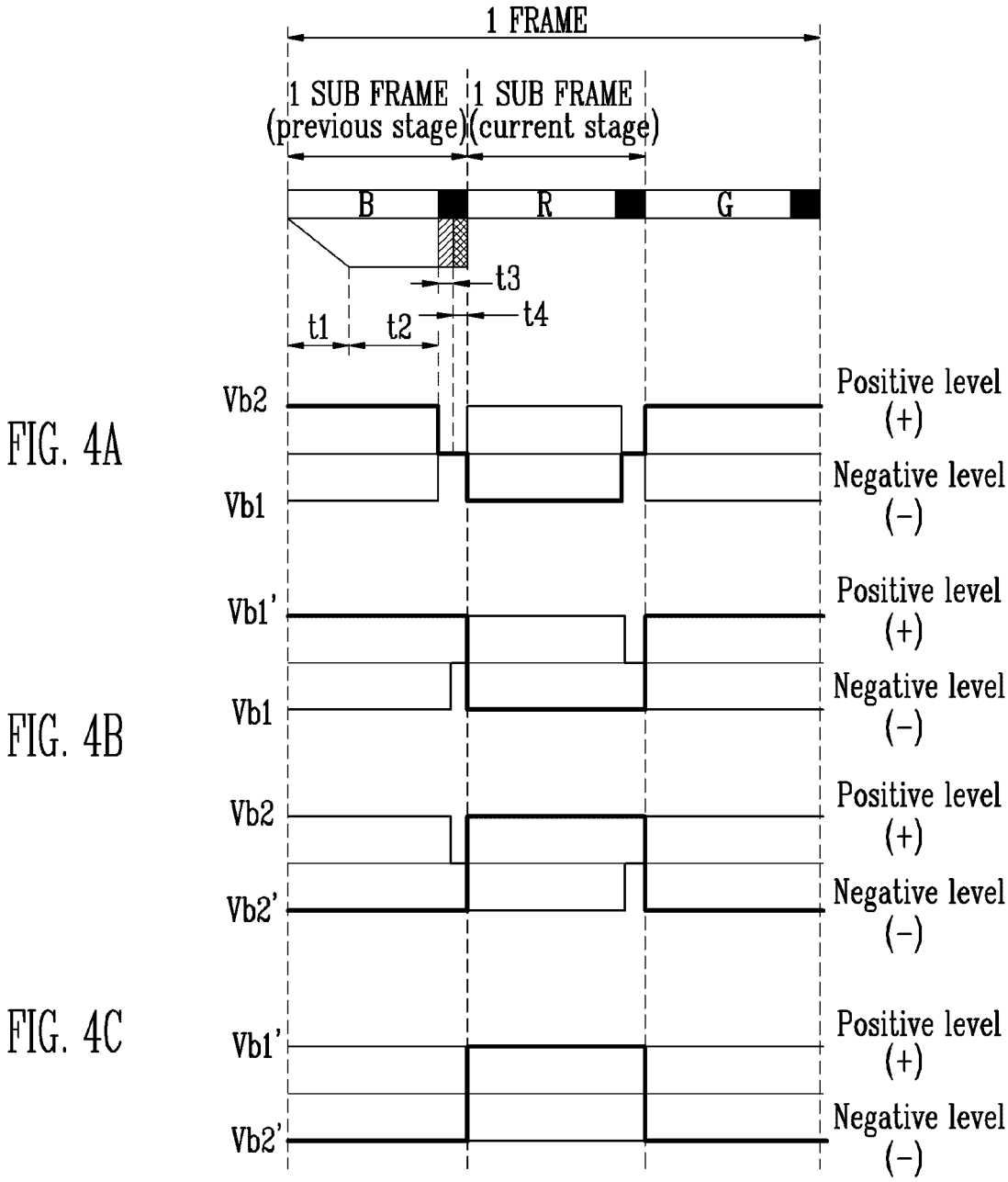
FIGS. 4A TO 4C are timing diagrams illustrating operation of a filed sequential liquid crystal display according to an embodiment of the present invention.

FIGS. 4A TO 4C are timing diagrams illustrating operation of a field sequential liquid crystal display according to an embodiment of the present invention.

With respect to FIGS. 4A TO 4C, timing diagrams of the common voltage Vcom, the boosting voltages Vb1 and Vb2, the boosting voltages Vb1' and Vb2' of reversed phase which are applied respectively differently from the embodiments as illustrated in FIGS. 2A to 2C will be described.

Moreover, FIGS. 4A TO 4C illustrate timing for projecting R-color light as one embodiment and the remaining G-color light and the B-color light are projected at a same timing sequence. In addition, a field sequential liquid crystal display will be described under the assumption that the R, G and B color lights are sequentially projected.

First, image data corresponding to the R-color light is input to the storage capacitor Cst of the respective pixels electrically connected to the scan lines while sequentially addressing the respective scan lines for addressing time 't1'.

Next, a hold time 't2' is time interval between a time when the image data is written to the storage capacitor of the pixel electrically connected to the final gate line and a time for turning 'on' the backlight to sufficiently project the sub frame of the previous stage light (B-color light).

The minimum interval of the hold time 't2' may be a time when the image data is written to the storage capacitor of the pixel electrically connected to the final gate line and the maximum time may be changed according to the design.

After that, after the hold time 't2', all pixels of the liquid crystal display panel are reset for a reset time 't3'. At this time, the backlight projection of the B-color light is completed before starting a reset 't3'.

Next, R-color light image data is written to all pixels of the liquid crystal display panel for a write time 't4'. At this time, charged accumulated in the storage capacitors Cst of the respective pixels are transmitted to the liquid crystal capacitor Clc and the boosting capacitor Cb and a backlight corresponding to the R-color light is projected after a write time 't4' so that the projection of the R-color light starts.

However, as described above, the voltage drop occurs when the voltage stored in the storage capacitor Cst is transmitted to the liquid crystal capacitor Clc and the boosting capacitor Cb by applying the write control signals W1 to Wn, and the voltage drop might disable the correct gray scale.

Therefore, referring to FIG. 2A and waveforms of FIG. 4A, the first embodiment of the present invention may overcome the drawbacks by applying the boosting voltage Vb1 or Vb2 after the write time 't4'.

That is, when it is assumed that the pixels are driven in a line inversion driving method, in a case where positive level (+) data is applied to odd numberth column, the first boosting voltage Vb1 having the positive level (+) voltage is applied to the second electrodes of the boosting capacitors Cb of the respective pixels in the odd numberth column and the pixel voltage stored in the liquid crystal capacitor Clc is boosted uniformly so that the problem caused by the voltage drop may be compensated.

Likewise, in a case where negative level (−) data is applied to the even numberth column, the second boosting voltage Vb2 having the negative level (−) voltage is applied to the second electrodes of the boosting capacitors Cb of the respective pixels in the even numberth column and the pixel voltage stored in the liquid crystal capacitor Clc is boosted uniformly so that the problem caused by the voltage drop may be compensated.

However, the boosting voltages Vb1 and Vb2, as illustrated, may be applied in correspondence to the addressing time 't1' and the hold time 't2' and the common voltage Vcom, as illustrated, may be applied as a DC voltage.

In addition, referring to FIG. 2B and waveforms of FIG. 4B, the second embodiment of the present invention is to further increase the pixel voltage applied to the liquid crystal using a data voltage lower than the case of the first embodiment, the boosting voltages of reversed phase Vb1' and Vb2' are applied to the second electrode of the liquid crystal capacitor Clc.

That is, when it is assumed that the pixels are driven by the line inversion driving method for maximizing a voltage range of the pixel voltage that is stored in the liquid crystal capacitor, in a case where the positive level (+) data is applied to the odd numberth column, the first boosting voltage Vb1 having the positive level (+) voltage is applied to the second electrodes of the boosting capacitors Cb of the respective pixels in the odd numberth column and on the contrary the first negative level (−) boosting voltage Vb1' is applied to the second electrode of the liquid crystal capacitor Clc so that the problem caused by the voltage drop may be compensated.

However, the boosting voltages Vb1' and Vb2' of reversed phase, as illustrated, may be applied for the reset time 't3' and the write time 't4'.

In addition, referring to FIG. 2C and waveforms of FIG. 4C, in the third embodiment of the present invention, the boosting voltages of reversed phase Vb1' and Vb2' are applied to the second electrode of the liquid crystal capacitor Clc in comparison to the first and second embodiments, and the common voltage Vcom is applied to the second electrode of the boosting capacitor Cb.

That is, when it is assumed that the pixels are driven by the line inversion driving method, in a case where the positive level (+) data is applied to the odd numberth column, the first negative boosting voltage of reversed phase Vb1' is applied to the second electrode of the liquid crystal capacitor Clc in the odd numberth column so that the problem caused by the voltage drop may be compensated.

However, the boosting voltages Vb1' and Vb2' of reversed phase, as illustrated, may be applied for the reset time 't3' and the write time 't4'.

The present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A liquid crystal display device comprising:

a liquid crystal display panel including a plurality of scan lines, a plurality of odd and even column data lines, and a plurality of pixels connected to the scan lines and the data lines, the pixels being arranged in a matrix form;

a control signal generating unit for providing a write control signal and a reset signal to the pixels of the liquid crystal display panel, respectively;

a common voltage generating unit for providing a common voltage to each of the pixels; and a boosting voltage generating unit for providing boosting voltages to the pixels such that only the pixels connected to an odd column data lines each receive a first boosting voltage and only the pixels connected to an even column data lines receive a second boosting voltage different from the first boosting voltage, each of the pixels comprising:

a first thin film transistor having a gate electrode connected to one of scan lines and a source electrode connected to one of the data lines;

a second thin film transistor having a source electrode connected to a drain electrode of the first thin film transistor and a gate electrode connected to a write control signal line providing the write control signal;

a third thin film transistor having a source electrode connected to a drain electrode of the second thin film transistor and a gate electrode connected to a reset control signal line providing the reset signal;

a storage capacitor provided between the drain electrode of the first thin film transistor and the common voltage generating unit;

a liquid crystal capacitor having a first electrode connected to the drain electrode of the second thin film transistor; and a boosting capacitor having a first electrode connected to the source electrode of the third thin film transistor and a second electrode connected to a drain electrode of the third thin film transistor.

2. The liquid crystal display device as claimed in claim 1, further comprising the second electrode of the of the boosting capacitor being connected to the boosting voltage generating unit to receive a corresponding one of the first and second boosting voltages.

3. The liquid crystal display device as claimed in claim 2, further comprising a second electrode of the liquid crystal capacitor being connected to the common voltage generating unit.

4. The liquid crystal display device as claimed in claim 1, further comprising a second electrode of the liquid crystal capacitor being connected to the common voltage generating unit.

5. The liquid crystal display device as claimed in claim 1, polarities of the first boosting voltage and the second boosting voltage being different at respective sub-frames.

* * * * *